US006170124B1

(12) United States Patent
Graf

(10) Patent No.: US 6,170,124 B1
(45) Date of Patent: Jan. 9, 2001

(54) CARD CLOTHING FOR FLATS OF A CARD

(75) Inventor: Ralph A. Graf, Freienbach (CH)

(73) Assignee: Graf + Cie AG, Rapperswill (CH)

( * ) Notice: Under 35 U.S.C. 154(b), the term of this patent shall be extended for 0 days.

(21) Appl. No.: 09/481,789

(22) Filed: Jan. 12, 2000

(30) Foreign Application Priority Data

Jan. 13, 1999 (DE) ..... 199 01 010

(51) Int. Cl.[7] ..... D01G 15/84
(52) U.S. Cl. ..... 19/114; 19/113
(58) Field of Search ..... 19/98, 99, 102, 19/104, 105, 110, 111, 113, 114

(56) References Cited

U.S. PATENT DOCUMENTS

| | | | | |
|---|---|---|---|---|
| 129,662 | * | 7/1872 | Hindle et al. | 19/114 |
| 401,991 | * | 4/1889 | Ashworth | 19/114 |
| 1,293,504 | * | 2/1919 | Midgley | 19/114 |
| 2,937,412 | * | 5/1960 | Hollingsworth | 19/114 |
| 3,058,168 | * | 10/1962 | Laroche | 19/114 |
| 3,151,362 | * | 10/1964 | Freitag | 19/114 |
| 3,290,729 | * | 12/1966 | Maynard | 19/114 |
| 4,295,248 | * | 10/1981 | Beneke et al. | 19/113 |
| 4,356,598 | * | 11/1982 | Graf | 19/114 |

FOREIGN PATENT DOCUMENTS

| | | | |
|---|---|---|---|
| 636134 | | 5/1983 | (CH) . |
| 2447470 | | 4/1975 | (DE) . |
| 2825506 | | 12/1979 | (DE) . |
| 1474889 | * | 5/1977 | (GB) 19/114 |

* cited by examiner

*Primary Examiner*—John J. Calvert
*Assistant Examiner*—Gary L. Welch
(74) *Attorney, Agent, or Firm*—Friedrich Kueffner

(57) ABSTRACT

A card clothing for flats of a card with a carrier element and a plurality of card wires received with at least one received section in the carrier element, wherein each card wire has at least one processing section arranged exposed outside of the carrier element. At least in one of the card wires the received section received in the carrier element has at least the same length as the processing section which is exposed outside of the carrier.

23 Claims, 3 Drawing Sheets

I
I
L
l
10
12
22
30
31
32
34
36
38
40
42
44
48
14
b

F1
10
12
14
30
31
32
34
36
38
40
42
44
46
48
h
D
β
α

CARD CLOTHING FOR FLATS OF A CARD

BACKGROUND OF THE INVENTION

1. Field of the Invention

The present invention relates to a card clothing for flats of a card with a carrier element and a plurality of card wires received with at least one received section in the carrier element, wherein each card wire has at least one processing section arranged exposed outside of the carrier element. The invention also relates to a carrier element which can be used for manufacturing such a card clothing.

2. Description of the Related Art

A card is used in manufacturing yarn for parallelizing the individual fibers of a raw material consisting of inordinate fibers. For this purpose, a card usually is essentially composed of a swift formed essentially in the form of a circular cylinder and a number of flats which are movable along a predetermined path relative to the swift extending approximately parallel to the circumferential surface of the swift. For processing the fibers of the raw material, the swift has on its circumferential surface a swift clothing formed, for example, by sawtooth wires, while the flats are equipped with flat clothings along the predetermined path on the side facing the swift. These flat clothings can also be constructed in the form of sawtooth wire sections which extend parallel to the predetermined path. However, also used for this purpose are flat clothings in the form of card clothings of the above-described type. In comparison to the all-steel clothings formed of sawtooth wire sections, the card clothings of the above-described type are distinguished by a substantially lower weight and by significantly lower manufacturing costs. In this connection, the weight of a flat equipped with a card clothing of the above-described type may be less than half the weight of a flat with a flat clothing formed from sawtooth wires. This not only results in a significantly lower energy consumption when operating a card, but also in less wear because the movement and guidance of the flats equipped with a card clothing of the above-described type along the predetermined path can take place using particularly low forces. For this reason, particularly when manufacturing inexpensive yarns having low quality requirements, card clothings of the above-described type are increasingly used.

However, it has been found problematic that the web-shaped carrier elements, which are composed of an elastic synthetic material and/or a plurality of fabric layers which are vulcanized together, tear already after a short time in the area of the received sections of the card wires. This is because, during the processing of the fiber material, substantial forces act on the carrier element in the area of the received sections of the card wires. For eliminating this deficiency, it has already been proposed in CH 636 134 to provide the carrier elements of card clothings of the above-described type with web-shaped reinforcement inserts. However, the manufacture of such carrier elements is comparatively very expensive, so that the cost reductions to be achieved by the use of these card clothings are at least partially eliminated.

In addition, when using the card clothings of the above-described type, it has been found to be a disadvantage that a large quantity of short fibers accumulates in the area of the processing sections of the card wires; for ensuring a reliable operation of the card, this requires a frequent cleaning of the card clothings of the flats.

SUMMARY OF THE INVENTION

In view of the above-described problems in the state of the art, the invention is based on the object of providing an inexpensive and low-wear card clothing of the above-described type which is able to ensure a reliable operation of a card in a simple manner.

In accordance with the present invention, this object is met by a further development of the known card clothings of the above-described type, in which at least in one of the card wires the received section received in the carrier element has at least the same length as the processing section which is exposed outside of the carrier.

This invention is based on the finding that the substantial wear observed when using the known card clothings is primarily due to the lever length between the processing tip arranged at the end of the processing section facing the carrier element and the carrier element, wherein the lever length is large in comparison to the length of the received section available for transmitting the processing forces acting on the processing section to the carrier element. In the card clothing further developed in accordance with the present invention, the reduction of the length of the processing section to a length corresponding at most to the length of the received section results in a change of the force transmission ratio between the processing forces acting on the processing section of the card wires and the received section of the card wires available for introducing these processing forces into the carrier element, wherein this change of the force transmission ratio is advantageous with respect to the wear of the card clothing. Consequently, tearing of the carrier element in the area of the received sections of the card wires received in the carrier element can be reliably prevented in case of the usually occurring processing forces even without the use of additional reinforcement inserts in the carrier element. Therefore, the further development of the known card clothings according to the invention can ensure a high resistance to wear in an economical manner.

Moreover, the reduction of the length of the processing sections additionally reduces the quantity of the short fibers accumulating during the operation of a card in the area of the card clothings according to the invention. This is due to the fact that generally only those short fibers can accumulate in the area of the card clothings whose length only slightly exceeds the length of the processing sections so that the reduction of the length of the processing sections results in a reduction of the short fiber portion separated by the card from the raw material. This result of the reduction of the length of the processing sections of the card wires proposed in accordance with the invention appears to be a disadvantage at first glance. However, it has been found, particularly when manufacturing inexpensive yarns with low quality requirements, that the reduced separation of short fibers and contamination from synthetic fibers with low contamination can be readily accepted in view of the advantages achieved as a result with respect to the infrequently required cleaning of the card clothings of the flats.

With respect to the resistance to wear of the card clothings according to the invention, it has been found to be particularly advantageous if the ratio of the length of the received section of the card wires received in the carrier element to the length of the processing section exposed outside of the carrier element is at least 3:1, preferably at least 5:1.

For reducing the quantity of the short fibers accumulating during the operation of a card in the area of the card clothings of the flats, it has been found particularly advantageous if the length of the processing sections exposed outside of the carrier element is shorter than 3 mm, preferably shorter than 2 mm, particularly preferably shorter than 1.5 mm.

It has been found to be particularly advantageous with respect to production technology if the received sections of the card wires extend through the carrier element starting from the rear side of the carrier element facing away from the processing section to the front side of the carrier element facing the processing section; this is because, when manufacturing card clothings according to the invention, the card wires can then be inserted—without damaging the front side of the carrier element which generally faces the swift during the processing of the fiber material—to such an extent into the rear side of the carrier element until the processing section emerges at the front side of the carrier element.

For securing the card wires in the carrier element, the card wires can be equipped at their ends of the received section facing away from the processing section with a holding section resting against the rear side of the carrier element. In this connection, it has been found to be particularly advantageous if the card wires have two processing sections located exposed outside of the carrier element as well as two received sections penetrating the carrier element, wherein the received sections are connected to each other through a connecting section resting against the rear side of the carrier element. For example, such card wires can be constructed essentially U-shaped, wherein each of the two outer sides of such a U-shaped card wire has a processing section exposed outside of the carrier element and a received section received in the carrier element and the leg of the card wire connecting the two outer sides with each other rests against the rear side of the carrier element.

For further improving the resistance to wear of the card clothings according to the invention, it has been found advantageous if, in a direction extending perpendicularly of the longitudinal axis of the card wire and approximately perpendicularly of the direction of the processing forces acting on the card wire during the processing of the raw material, the card wire has a width of at least 0.2 mm, preferably at least 0.4 mm, because it is possible in this manner that the pressure acting during the processing of the raw material through the card wires on the carrier element can be kept low without impairing the operation of the card, so that tearing of the carrier element in the area of the received sections of the card wires can be further counteracted.

For ensuring a stability of the carrier element which is as high as possible, care must be taken that during the insertion of the card wires into the carrier element the material displacement within the carrier element is not too great. Therefore, for ensuring a high stability of the carrier element, the card wires preferably have a cross-sectional area which is as small as possible in a sectional plane extending perpendicularly of the longitudinal direction of the card wires. On the other hand, in view of the processing forces occurring during the processing of the fiber material, a sufficiently high stability of the card wires in the direction of the processing forces must be ensured. When using the above-described card wires having a width of at least 0.2 mm, preferably at least 0.4 mm, it has been found that a sufficiently high stability of the card wires in the direction of the processing forces can be ensured if the card wires have a width of less than 6 mm, preferably less than 5 mm, particularly preferred about 4.8 mm, while avoiding an excessive weakening of the carrier element by the material displacement occurring in the carrier element. It has been found particularly advantageous if the ratio of the thickness to the width is less than 3. In accordance with an especially preferred embodiment of the invention, the card wires have an essentially square cross-section in a sectional plane extending perpendicularly of the longitudinal axis of the card wire.

In the known card clothings described above, an improvement of the engagement of the card wires with the fiber material is achieved if the processing section has at its end facing away from the carrier element a processing tip which is formed by two tip surface segments of the outer surface of the card wire extending at an acute angle of preferably less than 20°, particularly preferred about 16°, relative to each other, wherein at least one of the tip surface segments extends inclined relative to the longitudinal axis of the card wire and continues at a transition spaced in the direction of the longitudinal axis of the card wire from the processing tip in a rear outer surface segment of the outer surface of the card wire extending approximately parallel to the longitudinal axis of the card wire. Such processing tips are conventionally manufactured by grinding, embossing or punching card wires having a constant cross-section over the length thereof in a sectional plane extending perpendicularly of their longitudinal axes at one of their ends for preparing the tip surface segment extending inclined relative to the longitudinal axis. As a result, in the area of the transition between the tip surface segment manufactured in this manner and the rear outer surface segment extending parallel to the longitudinal axis of the card wire, usually so-called cutting beads are created to which the fibers to be parallelized can adhere. Therefore, conventional card wires must be subjected to a further grinding process for eliminating the cutting beads after manufacturing the processing tips. This correspondingly increases the costs for the manufacture of conventional card clothings.

This cost increase can be avoided while simultaneously avoiding the accumulation of fibers in the area of the processing sections of the card wires of a card clothing according to the invention if the transition between the tip surface segment extending inclined relative to the longitudinal axis of the card wire and the rear outer surface segment of the card wire is arranged within the carrier element because the cutting beads produced during the manufacture of the tip surface segment are no longer located exposed outside of the carrier element when the textile fibers are processed and, therefore, fibers cannot adhere to the cutting beads.

For achieving a particularly effective engagement of the card wires of a card clothing according to the invention into the fiber material, it has been found particularly advantageous if one of the tip surface segments extends approximately parallel to the longitudinal axis of the card wire and this tip surface segment includes an acute angle of approximately 5 to 30°, preferably approximately 5 to 20°, especially preferred approximately 12°, with a surface normal contacting the processing tip on the front side of the carrier element.

For ensuring a uniform processing or parallelizing of the individual fibers of the raw material, conventional card clothings have a receiving portion for receiving the received sections of the card wires, wherein the receiving portion has an essentially flat front side facing the processing sections. Such card clothings are conventionally fastened to a flat rod of the card by means of support clamps resting against the front side of the carrier element facing the processing sections. In this connection, the processing of the individual fibers of the raw material can be impaired by the support part of the support element resting against the front side of the carrier element. For eliminating this deficiency, it has been found advantageous if the receiving portion receiving the received sections of the card wires continues at at least one of its edges in a fastening portion whose front side facing the processing section is offset relative to the front side of the received section in the direction towards the rear side of the carrier element facing away from the processing sections.

In this arrangement, the distance between the front side of the receiving portion and the front side of the fastening portion in a direction extending perpendicularly of the front side of the receiving portion is available for mounting the support clamp, wherein the support part of the support clamp resting against the front side of the fastening portion does not impair the processing of the textile fibers by means of the processing sections of the card wires protruding from the receiving portion of the carrier element.

It has been found particularly advantageous with respect to manufacturing technology if the carrier element is constructed in the manner of a carrier web whose rear side facing away from the processing sections of the card wires is arranged in a plane extending approximately parallel to the front side of the processing portion, wherein the front side of the fastening portion can also be arranged in a plane extending approximately parallel to the front side of the processing portion.

For ensuring a reliable and uniform processing or parallelizing of the individual fibers of the raw material, the card clothings according to the invention have a width extending over the entire width of the swift of a card, while the length thereof in a direction extending parallel to the predetermined processing path is substantially shorter than the width of the swift. Consequently, the front side of the processing portion of the carrier element facing the processing path of the swift usually is essentially rectangular. A reliable fastening of the card clothing to the flat rod can be ensured if the rectangular front side continues at at least one of its longer side edges, preferably at both of its longer side edges, in a fastening portion extending approximately parallel thereto.

As already mentioned above, the card clothings according to the invention can be fastened to the flat rod of a card by means of a support element resting with a support part against the front side of the fastening portion of the carrier element and extending starting from the front side in the direction towards the rear side of the carrier element and possibly beyond, wherein a particularly reliable fastening is ensured if the support element has a fastening part penetrating the fastening portion of the carrier element.

As can be gathered from the above explanation of the card clothings according to the invention, a carrier element suitable for manufacturing such card clothings is essentially characterized in that it includes a receiving portion serving for receiving the received sections of the card wires with an essentially flat front side which continues at at least one of its edges in a fastening portion whose front side is offset relative to the front side of the receiving portion in the direction towards the rear side of the carrier element. Such a carrier element is preferably manufactured of an elastic synthetic material, such as, for example, polyvinyl chloride, polyurethane or polyamide, possibly with appropriate softeners.

For manufacturing card clothings according to the invention, it is advantageous to use carrier elements of synthetic material, particularly of PVC. In this connection, for increasing the strength, at least one fabric insert, preferably two fabric inserts which are spaced apart from each other in the thickness direction, are embedded in the carrier element.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
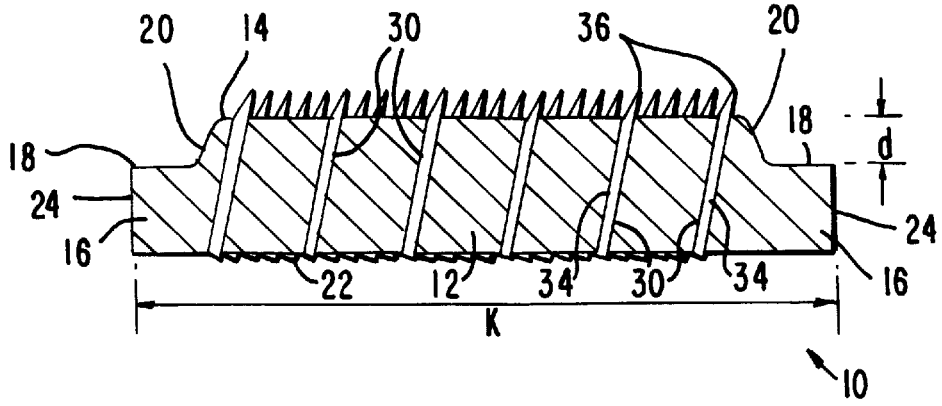
FIG. 1 is a sectional view of a card clothing according to the invention.

The card clothing shown in the drawing essentially is composed of a carrier element 10 and a number of card wires 30 inserted into this carrier element 10. When viewing FIGS. 1 and 5 together, it is apparent that the carrier element 10 is formed in the manner of a carrier web with a width B, which essentially corresponds to the width of the swift of the card, and with a substantially shorter length K in a direction extending parallel to the direction of movement of the flats indicated by the arrow F in FIG. 5 along the predetermined path. It is apparent from FIG. 1 that the carrier element has a central receiving portion 12 with a comparatively great thickness into which the card wires 30 are inserted and which continues at its two opposite edges into a fastening portion 16 each having a smaller thickness. For this purpose, the rear side 22 of the carrier element is essentially flat, while the front side 14 of the receiving portion 12 receiving the card wires 30 and having a greater thickness continues at both its opposite edges through steps 20 extending in the direction towards the rear side 22 into front sides 18 of the fastening portion 16 which is also essentially flat and extends approximately parallel to the rear side 22 of the carrier element 10. Consequently, the front sides 18 of the fastening portions 16 are offset parallel relative to the front side 14 of the receiving portion 12 in the direction towards the rear side 22 of the carrier element 10.

The edge portions 16 of the carrier element 10 having a smaller thickness are available for mounting support clamps which are usually used for fastening the card clothing to a flat rod. The height difference d between the front side 14 of the receiving portion 12 and the front side 18 of each fastening portion 16 makes it possible that the support clamps can be mounted in a manner which does not influence the effectiveness of the processing sections 36 of the card wires 30 which are exposed and protrude above the front side 14 of the receiving portion.

Figure 2:
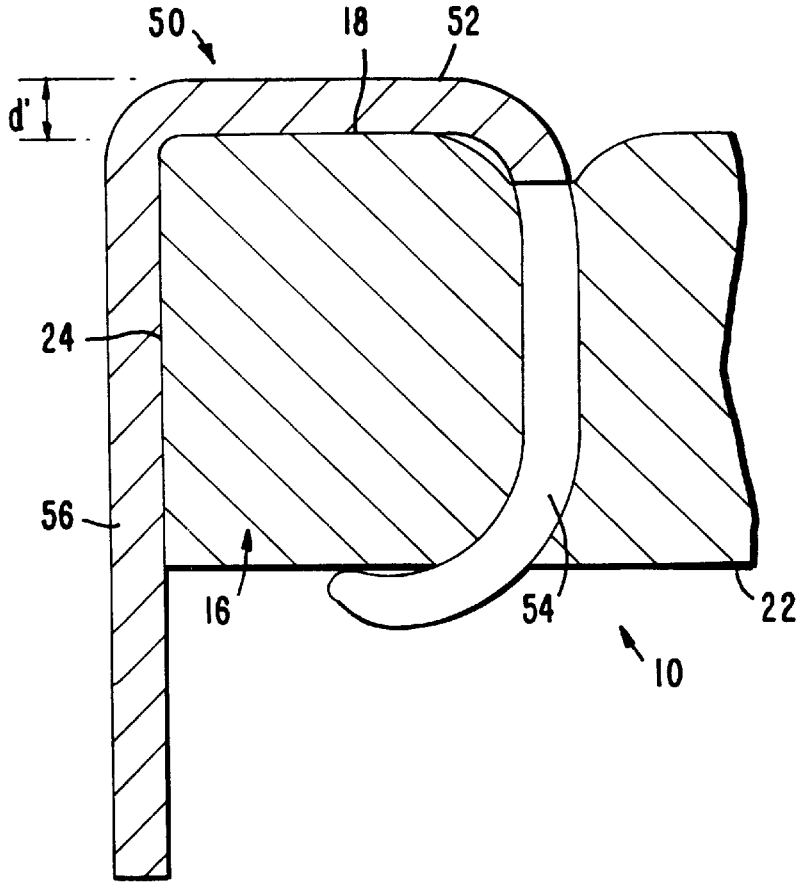
FIG. 2 is a detail illustration, on a larger scale, showing the fastening of a support clamp to the carrier element of the card clothing shown in FIG. 1.
Figure 5:
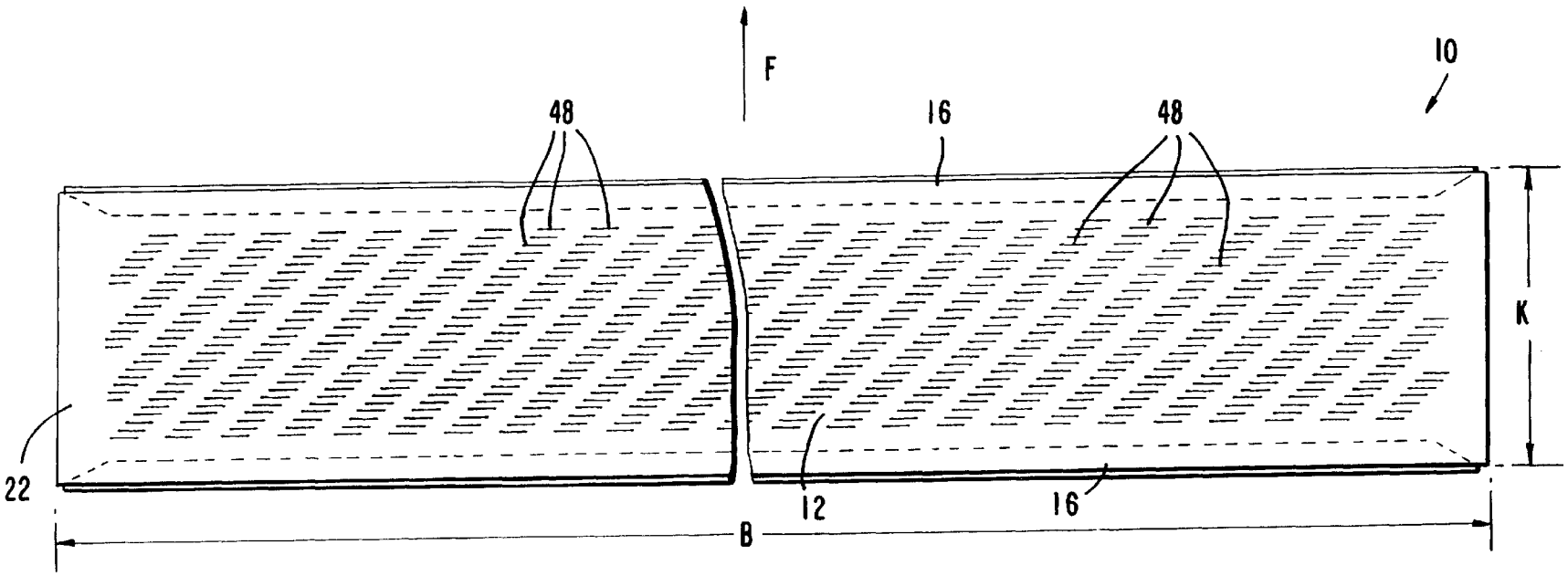
FIG. 5 is a rear view of the card clothing shown in FIG. 1.

FIG. 2 shows an example of mounting support clamps 50 at the oppositely located fastening portions 16 of the carrier element 10. In the embodiment of the invention illustrated in this figure, the support clamp 50 has a support part 52 resting against the front side 18 of the fastening portion 16, wherein, at its end facing away from the receiving portion 12 of the carrier element 10, the support part 52 has a clamp part 56 extending in the direction toward the rear side 22 and beyond and resting against a side surface 24 of the carrier element, and wherein, at its end facing the receiving portion 12, the support part 52 continues in a fastening part 54 penetrating the carrier element 10. The end of the fastening part 54 facing away from the support part 52 rests against the rear side 22 of the carrier element and ensures a reliable fastening of the support clamp 50 at the carrier element. On the other hand, the end of the clamp part 56 protruding beyond the rear side 22 of the carrier element 10 can be bent in a corresponding manner over a rear side of a flat rod in order to facilitate a reliable fastening of the card clothing to the flat rod. The thickness d' of the support part 52 in a direction extending perpendicularly of the front side 18 of the fastening portion 16 is smaller than the height difference d between the front side 14 of the receiving portion 12 and the front side 18 of the fastening portion 16. As a result, it is ensured that the effectiveness of the processing segments 36 of the card wires 30 located exposed outside of the carrier element 10 are not impaired by mounting the support clamp 50. As can be seen in FIG. 5, the fastening portions 16 arranged at the opposite edges of the carrier element 10 extend approximately over the entire width B of the web-shaped carrier element. This facilitates a secure and reliable fastening of the card clothing to a flat rod over the entire width thereof.

Figure 3:
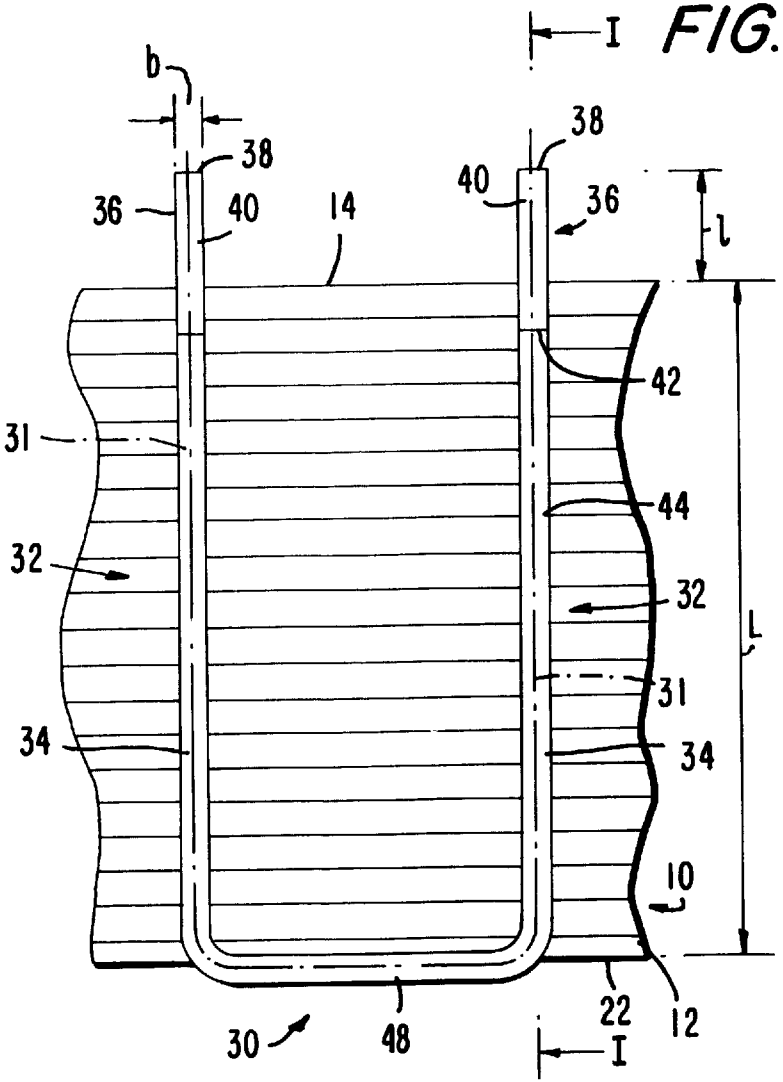
FIG. 3 is an illustration of a detail showing a card wire of the card clothing shown in FIG. 1.

As illustrated particularly clearly in FIG. 3, the individual card wires 30 inserted into the receiving portion 12 of the carrier element 10 are essentially U-shaped and have two outer sides 32 which are connected to each other through a connecting leg 48 resting against the rear side 22 of the carrier element. Each of the outer sides 32 has a received section 34 received in the receiving portion 12 of the carrier element 10 and a processing section 36 which is exposed and protrudes by a distance L above the front side 14 of the receiving portion 12. The length L of the receiving portions 34 in the direction of the longitudinal axis 31 of the card wire 30 is substantially greater than the length l of the processing sections 36, wherein the length l is about 1 mm and the length L is about 6 mm. As a result, an increased resistance to wear of the card clothing illustrated in the drawing is achieved, on the one hand, and a reduction of the quantity of short fibers accumulating in the area of the processing sections 36 is achieved, on the other hand. The width b of the individual card wires in a direction extending perpendicularly of the direction of movement F and parallel to the front side 14 of the receiving portion 12 is in the card clothing illustrated in the drawing about 0.2 mm, while the thickness D of the card wire in a direction extending perpendicularly of the plane defined by the longitudinal axis 31 and the width direction is about 0.48 mm (see FIG. 4). As a result, while ensuring a sufficient stability of the card wire in a direction extending parallel to the direction of movement F, a force introduction of the processing forces acting on the processing sections 36 during a processing procedure into the carrier element 10 which is advantageous with respect to the resistance to wear of the card clothing according to the invention is ensured, on the one hand, and a material displacement when inserting the card wires 30 into the receiving portion 12 of the carrier element 10 which is sufficiently small for guaranteeing a sufficient stability of the carrier element 10 is ensured, on the other hand.

Figure 4:
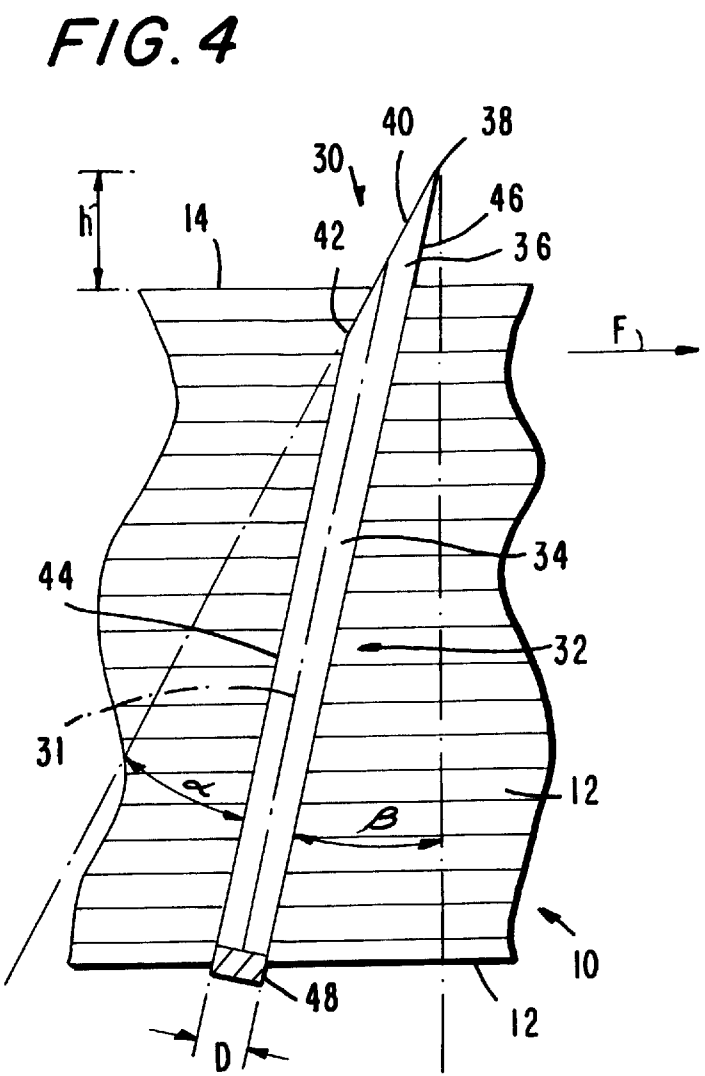
FIG. 4 is a sectional view of the card wire taken along sectional plane I—I in FIG. 3.

As illustrated particularly clearly in FIG. 4, the individual processing sections 36 of the card wires 30 have a processing tip 38 at their ends facing away from the front side 14 of the receiving portion 12. This processing tip 38 is formed by two tip surface segments 40 and 46 which include an acute angle $\alpha$ of about 16° with each other. The tip surface segment 46 which is in the front in the direction of the movement of the flats indicated by the arrow F along the predetermined processing path during a processing procedure extends approximately parallel to the longitudinal axis 31 of the card wire 30 and includes an acute angle $\beta$ of about 12° with a surface normal contacting the processing tip 38 onto the front side 14 of the receiving portion. The rear tip surface segment 40 located opposite the front tip surface segment 46 includes with the longitudinal axis 31 of the card wire 30 the acute angle $\alpha$ and, at a transition 42 spaced apart in the direction of the longitudinal axis 31 of the card wire 30 from the processing tips 38, continuous in a rear outer surface segment 44 which extends parallel to the longitudinal axis 31 of the card wire 30. The transition 42 is arranged within the receiving portion 12 of the carrier element 10. As a result, it is ensured that the cutting beads produced during the manufacture of the rear tip surface segment 40 by a grinding, punching or embossing process in the area of the transition 42 are not exposed outside of the carrier element and, consequently, are also not available for holding individual fibers of the raw material to be processed with the card clothing according to the invention. Therefore, when manufacturing the card clothing according to the invention, an additional grinding process usually required for eliminating the cutting beads in the area of the transition 42 are unnecessary.

As illustrated in FIG. 5, the connecting segments 48 of the card wires 30 extend approximately parallel to the width direction of the carrier element 10, wherein the card wires inserted into the carrier element 10 are combined into a plurality of processing strips which extend obliquely relative to the direction of movement indicated by the arrow F along the processing path and which extend parallel to each other. This ensures a uniform processing of the raw material over the entire width B of the card clothing.

The invention is not limited to the embodiment explained in connection with the drawing. Rather, it is also conceivable to vary the angle between the front tip surface segment 46 and the surface normal onto the front side 14 of the receiving portion 12 contacting the processing tip 38 within a range of between 5° and 20°. Moreover, instead of the card wires illustrated in the drawing with an essentially rectangular cross-section in a planar intersection extending perpendicularly of the longitudinal axis 31, it is also possible to use card wires with a square, round or oval cross-section. Furthermore, an embodiment is conceivable in which the front sides 18 of the fastening portions 16 extend starting from the side surfaces 24 in the direction toward the rear side 22 of the carrier element 10 in order to facilitate an even more reliable fastening of the support clamps 50.

The invention is not limited by the embodiments described above which are presented as examples only but can be modified in various ways within the scope of protection defined by the appended patent claims.

I claim:

1. A card clothing for flats of a card, the card clothing comprising a carrier element and a plurality of card wires, wherein each card wire is received with at least one received section in the carrier element, and wherein each card wire has at least one processing section located exposed outside of the carrier element, wherein the received section and the processing section each have a length, wherein in at least one of the card wires the received section has at least the same length as the processing section, and wherein in at least one of the card wires a ratio of the length of the received section to the length of the processing section is at least 3:1, wherein the processing section of each card wire has a processing tip formed by two tip surface segments of an outer surface of the card wire and including an acute angle with each other, wherein at least one of the tip surface segments extends inclined relative to a longitudinal axis of the card wire and, at a transition spaced apart from the processing tip in a direction of the longitudinal axis, continues in a rear outer surface segment extending parallel to the longitudinal axis of the card wire, wherein the transition is located within the carrier element.

2. The card clothing according to claim 1, wherein the ratio of the length of the received section to the length of the processing section is at least 5:1.

3. The card clothing according to claim 1, wherein in at least one of the card wires the length of the processing section is less than 3 mm.

4. The card clothing according to claim 3, wherein the length of the processing section is 1 mm.

5. The card clothing according to claim 1, wherein in at least one of the card wires the length of the processing section is less than 2 mm.

6. The card clothing according to claim 1, wherein in at least one of the card wires the length of the processing section is less than 1.5 mm.

7. The card clothing according to claim 1, wherein the at least one card wire has a longitudinal axis, and wherein the card wire has in a width direction extending perpendicularly of the longitudinal axis a width of at least 0.2 mm.

8. The card clothing according to claim 7, wherein the width of the card wire is at least 0.4 mm.

9. The card clothing according to claim 7, wherein in a plane extending perpendicular of the longitudinal axis and the width direction the card wire has a thickness of less than 6 mm.

10. The card wire according to claim 9, wherein the thickness is less than 5 mm.

11. The card clothing according to claim 9, wherein the thickness is 4.8 mm.

12. The card wire according to claim 9, wherein a ratio of the thickness to the width of the card wire is less than 3.

13. The card clothing according to claim 12, wherein, in a sectional plane extending perpendicularly of the longitudinal axis, the card wire has an essentially square cross-section.

14. The card clothing according to claim 1, wherein the acute angle is smaller than 20°.

15. The card clothing according to claim 1, wherein the acute angle is 16°.

16. The card clothing according to claim 1, wherein one of the tip surface segments extends approximately parallel to the longitudinal axis of the card wire and includes an acute angle with a surface normal contacting the processing tip onto a front side of the carrier element.

17. The card clothing according to claim 16, wherein the acute angle is 5 to 30°.

18. The card clothing according to claim 16, wherein the acute angle is 5 to 20°.

19. The card clothing according to claim 16, wherein the acute angle is 12°.

20. The card clothing according to claim 1, wherein the carrier element has a receiving portion receiving the received sections of the card wire, wherein the receiving portion has an essentially flat front side facing the processing section of the card wire, wherein the receiving portion continues at least at one edge thereof in a fastening portion, wherein a front side of the fastening portion facing the processing section is offset relative to the front side of the receiving portion in a direction towards a rear side of the carrier element facing away from the processing sections, wherein the rear side of the carrier element is located in a plane extending approximately parallel to the front end of the receiving portion, and wherein the front side of the fastening portion is located in a plane extending approximately parallel to the front side of the processing portion.

21. The card clothing according to claim 20, further comprising a support element for supporting the card clothing on a flat rod, wherein the support element comprises a support part resting against the front side of the fastening portion and extending from the front side in a direction towards the rear side of the carrier element and beyond, and wherein the support element comprises a fastening part extending through the fastening portion.

22. The card clothing according to claim 1, wherein the carrier element is essentially of synthetic material.

23. The card clothing according to claim 22 wherein the synthetic material is PVC.

* * * * *